United States Patent [19]

Hillman

[11] 4,048,050

[45] Sept. 13, 1977

[54] CHILD-PROOF CONTAINER FOR MEDICINES AND THE LIKE

[76] Inventor: Ernest C. Hillman, 1277 S. Adams St., Glendale, Calif. 91205

[21] Appl. No.: 766,130

[22] Filed: Feb. 7, 1977

[51] Int. Cl.[2] ..... B65D 43/20; B65D 85/56

[52] U.S. Cl. ..... 206/1.5; 220/281; 220/331; 220/346; 215/201

[58] Field of Search ..... 220/329, 331, 346; 206/1.5, 536, 540; 215/201

[56] References Cited

U.S. PATENT DOCUMENTS

| | | | |
|---|---|---|---|
| 3,187,926 | 6/1965 | Zimmet | 220/346 |
| 3,907,103 | 9/1975 | Shaw | 220/281 X |
| 3,942,630 | 3/1976 | Phillips | 206/1.5 |

*Primary Examiner*—George T. Hall

*Attorney, Agent, or Firm*—Fulwider, Patton, Rieber, Lee & Utecht

[57] ABSTRACT

A container for medicines and the like that is not readily openable by children, including an enclosure and a cover that is movable both pivotally and longitudinally on the enclosure. A pivot latch will not permit the cover to be pivoted to an open position unless it has first been moved longitudinally, which requires that the sides of the enclosure be pressed inwardly to release a slide latch.

22 Claims, 6 Drawing Figures

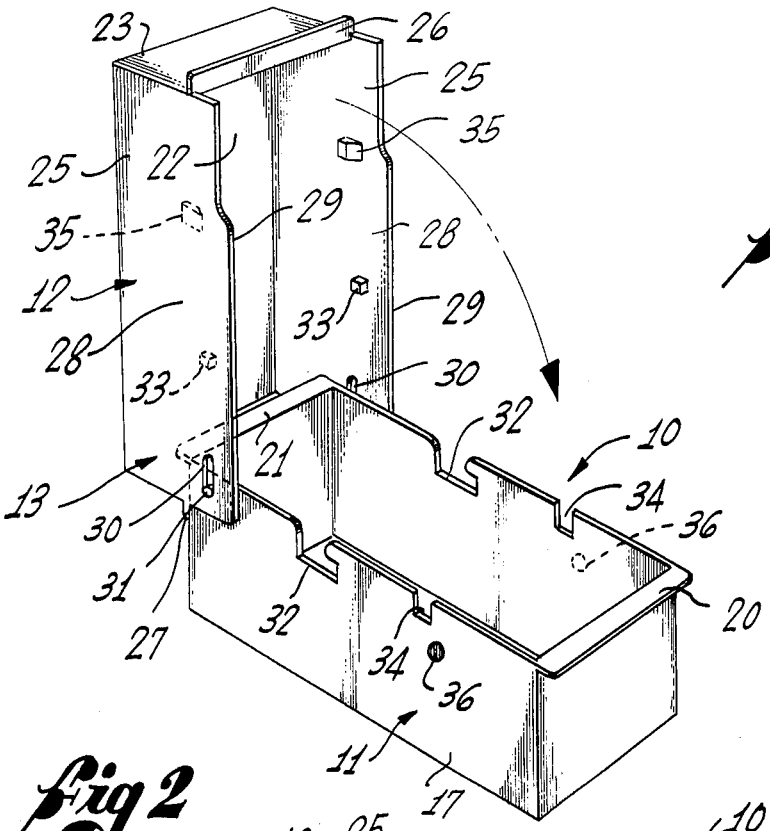
Fig. 1
Fig 2
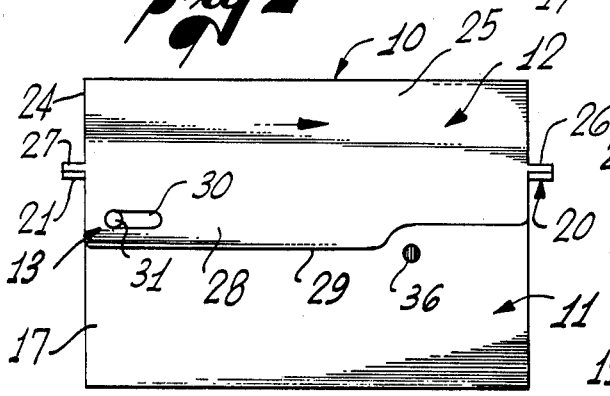
Fig. 3
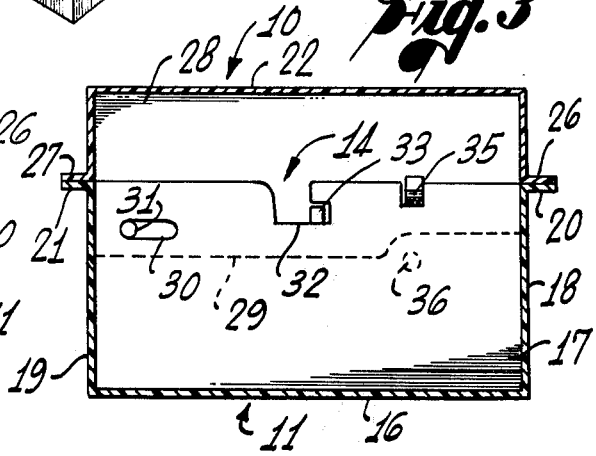
Fig. 4
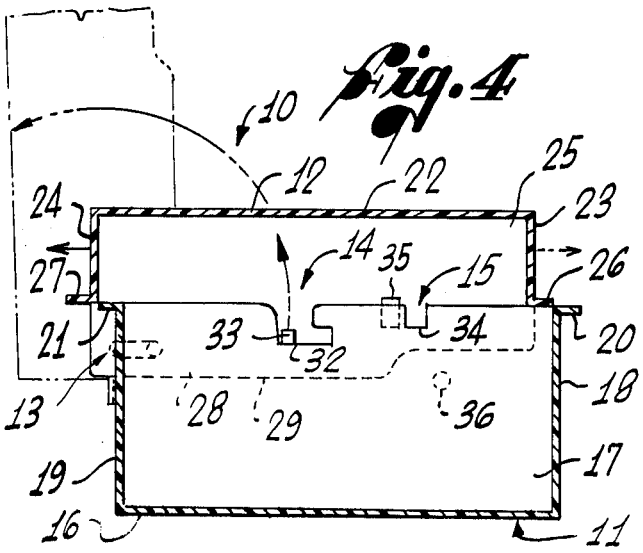
Fig. 5
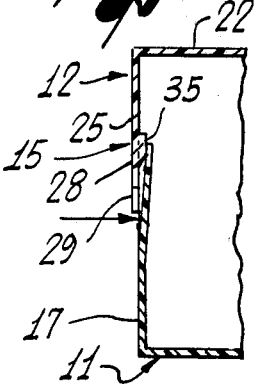
Fig. 6
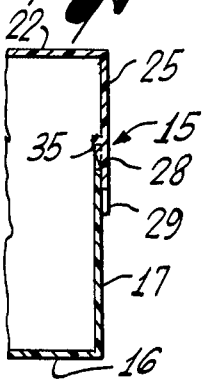

CHILD-PROOF CONTAINER FOR MEDICINES AND THE LIKE

BACKGROUND OF THE INVENTION

The present invention relates to containers for medicine and the like, and more particularly to such containers that are not readily openable by children.

Young children have a well known tendency to put small objects in their mouths and to swallow them with no awareness of the potentially harmful effects. They also have a fascination for containers, such as medicine bottles, which are usually of a small size and are sometimes brightly colored. Tragic results have followed when children follow their natural propensities leading them to ingest medicines when left unattended for only a short time.

Medicine containers have been proposed that are intended to be difficult or impossible for children to open. For the most part, such "child-proof" containers that are in common use today are bottles with caps that are removable by some combination of twisting, pushing and pulling actions. In general, they require a degree of dexterity and strength that young children do not possess. However, containers that provide adequate protection against being opened by children often present considerable inconvenience and difficulty for adults, especially those who are physically handicapped by diseases, such as arthritis.

A principal object of the present invention is to provide a child-proof container for medicines and the like that is easily opened by adults who know how it operates and does not require more than a small degree of strength and dexterity. Another object is to provide a relatively large, box-like, child-proof container in which a number of smaller medicine bottles of conventional design can be stored.

SUMMARY OF THE INVENTION

The present invention is a container for medicines and other articles that are dangerous to small children. It comprises an enclosure with a cover that can be pivoted to an open position only after it has been moved longitudinally from one closed position to another. More specifically, a pivot latch prevents pivotal movement of the cover from a first closed position, but permits pivotal movement from a second closed position. Longitudinal movement of the cover from its first to its second position is restrained by a slide latch that can be released by pressing the sides of the enclosure inwardly.

The pivot latch can be formed by a pin that rides in a slot extending in the direction of longitudinal movement of the cover and having an open end and a closed end. When the cover occupies its first closed position, the pin is located at the closed end of the slot and holds the cover against pivotal movement, but when the cover is in its second closed position, the pin is aligned with the open end of the slot through which it can be withdrawn as the cover is pivoted to an open position.

The slide latch can be formed by a detent received by a notch or other deformation when the cover in its first closed position. When the container is to be opened, the detent is released from the notch by flexing the enclosure sidewalls inwardly, permitting the cover to move longitudinally to its second closed position from which it can be opened. The detent may be tapered so that it urges the sidewalls of the enclosure inwardly to reassume the seond closed position as the cover is swung shut. Perferably, there are two detents and two corresponding notches on opposite sides of the container so that both sides must be pressed simultaneously before longitudinal movement of the cover is possible. The size of the container can be such that a child's hand is not large enough to press both sides at the same time.

The child-proof latching action of the present invention is particularly suitable for a straight-sided, box-like structure that can be used as a convenient master container for several medicine bottles and other dangerous articles, such as razor blades and poisons. Access to a number of different items can be provided by opening the container only once. Moreover, the container provides a safe and convenient compartment for medicines when traveling.

Other features and advantages of the present invention will become apparent from the following detailed description, taken in conjunction with the accompanying drawings which illustrates, by way of example, the principles of the invention.

BRIEF DESCRIPTION OF THE DRAWINGS

FIG. 1 is a three dimensional pictorial view of a child-proof container constructed in accordance with the present invention, the container being shown with its cover in an open position;

FIG. 2 is a side elevation of the container latched in its first closed position;

FIGS. 3 and 4 are cross-sectional views taken vertically through the container from end to end, the container being shown in its first and second (latched and unlatched) closed positions, respectively;

FIG. 5 is a fragmentary cross-sectional end view of the container showing the left-hand side thereof in its second closed position; and FIG. 6 is a fragmentary view similar to that of FIG. 5 showing the right-hand side of the container in its first closed position.

DESCRIPTION OF THE PREFERRED EMBODIMENT

The present invention is embodied in an exemplary container 10 for medicines and the like, illustrated in the accompanying drawings. Although it is not readily openable by children, it is easily and conveniently openable by adults using a simple combination of sliding and pivoting movements that do not require unusual strength of dexterity. In general, the container 10 comprises a box-like enclosure 11, a cover 12, a pair of hinges 13 that permit the cover to move longitudinally and pivot on the enclosure, a pair of pivot latches 14 that permit the cover to pivot only after it has been moved longitudinally, and a pair of slide latches 15 that restrain longitudinal movement of the cover.

The enclosure 11, as shown in FIG. 1, is a generally rectangular, box-like, plastic structure large enough to contain a plurality of conventional medicine bottles or the like. It includes a flat bottom 16, a pair of parallel vertical sidewalls 17 and front and back walls 18 and 19. A pair of horizontal flanges 20 and 21 extend outwardly along the top edges of its front and back walls 18 and 19.

The cover 12 is a shallow, plastic, rectangular structure having a flat top 22 with short front, back and sidewalls 23, 24 and 25, respectively, extending downwardly about its perimeter. With the cover 12 in its normal closed and latched position, as shown in FIGS. 2 and 6, its front and back walls 23 and 24 are vertically aligned with those of the enclosure 11, and a pair of narrow flanges 26 and 27 extending from the front and back cover walls rest on the corresponding flanges 20 and 21 of the enclosure.

The cover 12 is slightly wider than the enclosure 11 and its sidewalls 25 include extended portions 28 along their lower boundaries that overlay upper portions of the parallel enclosure sidewalls 17. The extended portions 28 have stepped bottom edges 29 so that the rearward two-thirds of each extension projects downwardly over a greater portion of the enclosure 11 than does the forward one-third.

Each of the two hinges 13 is formed by an elongated slot 30 in which a hinge pin 31 is received. The slots 30 extend horizontally from front to back along the extended portions of the cover sidewalls 25 near the cover back wall 24, and the pins 31 project outwardly from the opposing portions of the enclosure sidewalls 17. When the cover 12 is closed and the front and back walls of the cover and the enclosure 11 are aligned, the pins 31 are located at the rear of the slots 30. This aligned position is referred to as the first closed position of the cover 12 (FIGS. 2, 3 and 6). The hinges 13 permit the cover 12 to be moved longitudinally toward the rear of the enclosure 11 so that the pin 31 is located at the front of the slot 30, this being the second closed position of the cover (FIGS. 4 and 5).

The pivot latch 14 is formed by a pair of bayonettype slots 32 in the enclosure sidewalls 17 underneath the extended portions 28 of the cover sidewalls and forward of the hinges 13. Each slot 32 has an elongated horizontal portion closed at its forward end, but is open at its rearward end, where a short vertical portion extends upwardly to the top of the enclosure 11. On the inside of each extended portion of the cover 12 is a small dog 33 that is insertable through the vertical portion of the slot 32 into the horizontal portion where it can slide as the cover 12 is moved longitudinally between its first and second closed positions.

When the cover 12 is in its first closed position, the dog 33 which is located at the closed forward end of the slot 32, prevents the cover from being pivoted to an open position. The pivot latch 14, therefore, requires that the cover 12 be moved longitudinally toward the rear of the enclosure 11 to bring the dog 33 to the rear of the slot 32 before the cover can be opened. It should be noted that the flange 21 on the back wall 19 of the enclosure 11 also interferes with pivoting of the cover 12 until the cover has moved rearwardly so that the back wall 24 of the cover can be moved downwardly past the flange. Therefore, the rear flange 21 of the enclosure 11 may be considered another form of pivot latch that prevents the cover 12 from being opened until after it has been moved longitudinally.

The slide latch 15 that normally restrains longitudinal movement of the cover 12 includes a pair of deformations in the form of notches 34 in the top edges of the sidewalls 17 and a pair of detents in the form of projections 35 molded on the inner surface of the extended cover portions. The detents 35 are received by the notches 34 to anchor the cover 12 in the first closed position. When it is desired to move the cover rearwardly to its second closed position so that it can be opened, the flexible sidewalls 17 of the enclosure 11 can be bent inwardly to release the detents 35 from the notches 34 as best shown in FIG. 5. Colored marks 36 on the outside of the enclosure sidewalls 17 indicate the area in which the enclosure 11 must be squeezed to release the detents 35. Preferably the width of the enclosure is such that both marks 36 cannot be pressed simultaneously by the hand of a small child.

Each detent 35 of the slide latch 15 is wedge-shaped, merging with the cover sidewalls 25 along its lower edge 29 and being thickest at the top. When the cover 12 is pivoted to its first closed position, with the dog 33 aligned with the open end of the slot 32, the detent 35 is not aligned with the notch 34, but the tapered shape of the detent causes it to bend the enclosure sidewalls 17 inwardly, allowing the cover 12 to close. The cover 12 can then be moved forward, allowing the detents 35 to snap into the notches 34 to lock the cover against further longitudinal movement.

It will be understood from the foregoing that when the container 10 is latched in a first closed position, the cover 12 cannot be opened unless it is first moved longitudinally into its second closed position. To permit this longitudinal movement, the enclosure sidewalls 17 must be pressed simultaneously inwardly to release the slide latch 15 so that the detents 35 can pass along the outside of the enclosure 11 until the dog 33 reaches the open end of the pivot latch slot 32. The cover 12 can then be pivoted about the hinge 13, and the back wall 24 of the cover 12 will clear the rear flange 21 of the enclosure 11. When the cover 12 is later swung closed, the rear flange 21 of the enclosure 11 which must clear the inside of the cover back wall 24, functions as a guide for preventing the cover from sliding forward toward its first closed position as it is pivoted, thereby insuring that the dog 33 will be properly aligned to reenter the pivot latch slot 32. The tapered detents 35 force the enclosure sidewalls 17 inwardly as the cover 12 is seated on the enclosure 11 in its second closed position. Finally, the cover 12 is moved longitudinally to its first closed position permitting the detents 35 to snap into the notches 34.

The container 10 is substantially child-proof because of the simple but unusual sequence of movements needed to open it, although it is easily operated by an adult and does not require more than ordinary strength and dexterity.

While a particular form of the invention has been illustrated and described, it will be apparent that various modifications can be made without departing from the spirit and scope of the invention.

I claim:

1. A closable container that is not readily openable by children comprising:

an enclosure;

a cover for said enclosure;

hinge means for connecting said cover to said enclosure while permitting both pivotal opening movement and longitudinal sliding movement of said cover relative to said enclosure;

pivot latch means for preventing said pivotal movement of said cover prior to longitudinal movement thereof; and slide latch means for restraining longitudinal movement of said cover.

2. The container of claim 1, wherein said enclosure and said cover have opposing sidewalls;

said slide latch means comprises a detent projecting from one of said sidewalls and a deformation formed on another of said sidewalls to receive said detent.

3. The container of claim 2, wherein at least one of said sidewalls is flexible to release said detent from said deformation, 4. The container of claim 2, wherein at least one of said sidewalls is flexible and said detent is tapered to cause bending of said flexible sidewalls when said detent is not aligned with said deformation.

5. The container of claim 2, wherein said deformation is a notch formed on a top edge of one of said sidewalls that is part of said enclosure.

6. The container of claim 1, wherein said pivot latch means comprises:

a slot extending in the direction of longitudinal movement of said cover, having an open end and a closed end; and a dog slidable along said slot and insertable in said slot through said open end.

7. The container of claim 1, wherein said hinge means comprises:

at least one slot extending in the direction of said longitudinal movement of said cover; and a hinge pin slidably and pivotably received within said slot.

8. A closable container that is not readily opened by children comprising:

a box-like enclosure having at least two bendable, parallel sidewalls;

a cover for said enclosure having at least two parallel sidewalls that are outwardly disposed from and opposing said enclosure sidewalls;

hinge means for connecting said cover to said enclosure while permitting pivotal opening movement of said cover and permitting longitudinal sliding movement of said cover between first and second closed positions;

pivot latch means for preventing said pivotal movement of said cover when in said first closed position and permitting said pivotal movement of said cover when in said second closed position; and slide latch means for restraining longitudinal movement of said cover from said first closed position to said second closed position.

9. The container of claim 8, wherein:

said slide latch means comprises a detent projecting from one of said sidewalls; and a deformation formed on an opposing one of said sidewalls;

said deformation being positioned to receive said detent when said cover is in said first closed position.

10. The container of claim 9, wherein said deformation is arranged to release said detent in response to bending of said sidewalls, thereby permitting said longitudinal movement of said cover from said first closed position to said second closed position.

11. The container of claim 9, wherein said detent is tapered to cause bending of said bendable sidewalls as said cover is pivoted toward said second closed position.

12. The container of claim 8, wherein said deformation is a notch formed on a top edge of one of said enclosure sidewalls.

13. The container of claim 8, wherein said pivot latch means comprises:

a slot extending in the directon of longitudinal movement of said cover having an open end and a closed end; and a dog slidable along said slot and insertable in said slot through said open end.

14. The container of claim 8, wherein said hinge means comprises:

at least one slot extending in the direction of said longitudinal movement of said cover; and a hinge pin is slidably and pivotably received within said slot.

15. The container of claim 8, wherein said slide latch means comprises:

a pair of deformations on opposite sides of said container; and a pair of detents engageable with said deformations when said cover is in said first closed position;

whereby two sides of said enclosure must be pressed simultaneously to release said slide latch means.

16. The container of claim 8, further comprising flange means extending outwardly from said enclosure for preventing said cover from moving towards its first closed position as it is pivoted toward its second closed position.

17. The container of claim 8, further comprising flange means extending outwardly from said enclosure for preventing said cover from moving toward said first closed position as it is pivoted toward said second closed position.

18. A closable container for medicines or the like that is not readily openable by children comprising:

a generally rectangular, box-like enclosure having at least two parallel sidewalls;

a cover for said enclosure having at least two parallel sidewalls outwardly disposed from and opposing said enclosure sidewalls;

hinge means for connecting said cover to said enclosure permitting longitudinal sliding movement of said cover between first and second closed positions and pivotal opening movement of said cover, said hinge means comprising a pair of slots formed in said sidewalls and extending in the direction of longitudinal movement of said cover and a pair of hinge pins carried by said sidewalls that are rotatably and slidably received by said slots;

pivot latch means for preventing said pivotal movement of said cover from said first closed position and permitting said pivotal movement of said cover from said second closed position, said pivot latch means being formed by a pair of elongated slots formed in said enclosure and extending in the direction of said longitudinal movement of said sidewalls, each slot having an open end and a closed end, and a pair of dogs each slidably and pivotally received by one of said slots; and slide latch means for restraining longitudinal movement of said cover from said first closed position to said second closed position, said slide latch means including a pair of notches formed on the top edges of said enclosure sidewalls, and a pair of detents carried by said cover sidewalls and positioned to be received by said notches when said cover is in said first closed position, said detents being tapered to bend said enclosure sidewalls inwardly in response to pivotal movement of said cover toward said second closed position.

19. The container of claim 18, wherein said slot has an elongated horizontal portion parallel to a top edge of said enclosure and a shorter vertical portion extending to said top edge.

20. The container of claim 19, wherein said pivot latch means is located between said hinge means and said slide latch means.

21. The container of claim 18, further comprising means for preventing said cover from moving toward said first closed position as it is pivoted toward said second closed position.

22. The container of claim 18, further comprising: flange means extending outwardly from said enclosure for preventing said cover from moving toward said first closed position as it is pivoted toward said second closed position.

* * * * *